United States Patent [19]

Hattori et al.

[11] Patent Number: 4,756,239

[45] Date of Patent: Jul. 12, 1988

[54] ANTI-ROLLING STRUCTURE FOR DOUBLE HEADED PISTON OF DISC CAM TYPE RECIPROCATIVE COMPRESSOR

[75] Inventors: Mitsuhiro Hattori; Katsunori Kawai; Masayuki Tanikawa; Takashi Okamoto, all of Kariya, Japan

[73] Assignee: Kabushiki Kaisha Toyoda Jidoshokki Seisakusho, Aichi, Japan

[21] Appl. No.: 122,256

[22] Filed: Nov. 18, 1987

[30] Foreign Application Priority Data

Nov. 28, 1986 [JP] Japan ..... 61-184667[U]
Dec. 18, 1986 [JP] Japan ..... 61-302594

[51] Int. Cl.[4] ..... F01B 3/00; F04B 1/12; F04B 27/03

[52] U.S. Cl. ..... 92/71; 92/147; 417/269; 91/502; 74/56

[58] Field of Search ..... 92/12.2, 57, 71, 147; 91/502, 506; 417/269, DIG. 1; 74/56, 569

[56] References Cited

U.S. PATENT DOCUMENTS

| | | | |
|---|---|---|---|
| 2,567,576 | 9/1951 | Palumbo | 74/56 |
| 3,374,684 | 3/1968 | Greven | 74/56 |
| 4,432,310 | 2/1984 | Waller | 74/56 |
| 4,638,547 | 1/1987 | Waller | 74/567 |

FOREIGN PATENT DOCUMENTS

| | | | |
|---|---|---|---|
| 0110783 | 7/1982 | Japan | 417/269 |
| 675633 | 7/1952 | United Kingdom | 74/60 |

*Primary Examiner*—Robert E. Garrett
*Assistant Examiner*—Thomas Denion
*Attorney, Agent, or Firm*—Burgess, Ryan & Wayne

[57] ABSTRACT

An anti-rolling structure for a double headed piston of a disc cam type reciprocative compressor, comprising a cylinder block (1) through which a plurality of pairs of front and rear cylinder bores (4) are provided in parallel to a drive shaft (3) rotatably secured in the center of the cylinder block (1), and a double headed piston (8) slidably inserted in the respective pair of cylinder bores (4) for reciprocation in the longitudinal direction. A disc cam (13) having opposite sinuous surfaces (13') and rotatably accommodated within a cam chamber (5) is fixedly secured to the drive shaft (3), and a pair of front and rear cam rollers (14F, 14R) are arranged between the disc cam (13) and the piston (8) in a slidable and rotatable manner so as to nip the disc cam (13) between both cam rollers (14F, 14R) to transmit the rotation of the disc cam (13) to the piston (8) as a reciprocation in the longitudinal direction thereof. The front and rear cam rollers (14F, 14R) are positioned so that the axes of rotation thereof are not included in the center plane defined by longitudinal axes of the piston (8) and the disc cam (13) but disposed, respectively, in the opposite areas sectioned by the center plane with a substantially equal deviation from each other from the center plane. According to the above structure, the rolling motion of the piston (8) can be effectively restricted throughout the operation of the compressor.

4 Claims, 7 Drawing Sheets

ANTI-ROLLING STRUCTURE FOR DOUBLE HEADED PISTON OF DISC CAM TYPE RECIPROCATIVE COMPRESSOR

BACKGROUND OF THE INVENTION

1. Field of the Invention

The present invention relates to a disc cam type recirocative compressor for use in an air conditioning system for a vehicle. In particular, it relates to an improvement for restricting the rolling motion of the piston during operation in the vicinity of the upper and lower dead points of the stroke of the piston provided in the compressor of the above type, which compressor comprises a disc cam having an operating surface formed in a sinuous shape on each side thereof and a double headed piston, a cam roller being arranged between the cam and the piston while in sliding contact therewith, so that one rotation of the disc cam is transmitted to the piston through the contact with the cam roller to cause two reciprocations of the piston, whereby a compression of the operating fluid can be realized.

2. Description of the Related Arts

A disc cam type compressor, as disclosed in Japanese Unexamined Patent Publication (Kokai) No. 57-110783 and Utility Model Publication (Kokai) No. 57-114184, has a structure typically illustrated in FIGS. 1, 10, 11, and 12, in which a plurality of pairs of oppositely arranged front and rear cylinder bores 4 are provided through the interior of a cylinder block 16 with a cam chamber 5 intervening between each pair of the bores 4. The respective pairs of bores 4 are arranged in parallel to a drive shaft 3 and equiangularly to each other in the transverse cross-section of the cylinder block 16. A disc cam 13 having sinuously curved front and rear surfaces 13' is fixedly secured on the drive shaft 3 so as to rotate within the cam chamber 5 with the rotation of the drive shaft 3. In the respective pair of bores 4, a double headed piston 8 is slidably inserted so as to be movable in the forward and rearward directions. The piston 8 has a recess 15 in the inner walls opposite to the cam surface respectively for accommodating a cam roller 14F or 14R, whereby the piston 8 can be smoothly and reciprocatedly driven in the forward and rearward directions through the slidable and rotatable nip of the cam rollers 14F and 14R in accordance with the rotation of the disc cam 13. In this prior art compressor, axes c of rotation of a pair of the associated cam rollers 14F and 14R are transverse to a longitudinal axis b of the piston 8.

According to the above nipping mechanism of the cam rollers 14F and 14R for the disc cam 13, a serious problem of a rolling motion of the piston 8 during operation arises in the vicinity of the upper and lower dead points of the stroke of the piston 8. That is, the piston 8 is liable to move transversely toward the periphery of the disc cam 13 in an undesirable manner at these dead points, which, in turn, results in an abnormal noise. More specifically, when the piston 8 is moving from one dead point (for example, the lower dead point) to the other dead point (for example, the upper dead point) as shown in FIG. 12, contact points i, i of the cam rollers 14F, 14R against the disc cam 13 exist in areas opposite to each other relative to a plane including the longitudinal axis b of the piston 8 and that of the disc cam 13, while nipping the disc cam 13 between both cam rollers 14F and 14R. According to this well-balanced arrangement of the contact points, the rolling motion (in the up-down direction in FIG. 12) of the piston 8 can be restricted by either of the cam rollers 14F or 14R during the middle phase of the stroke of the piston 8. However, when the piston 8 has reached the dead point, as shown in FIG. 11, both the contact points i, i of the cam rollers 14F, 14R are positioned on the longitudinal axis b of the piston 8. This means that the action of the cam rollers 14F, 14R for restricting the up-down movement of the piston 8 is cancelled. Thus, the rolling motion of the piston 8 is liable to occur, especially during high speed operation, and in this case, a bridge portion 8' of the piston 8 touches the outer periphery of the disc cam 13 to generate noise.

SUMMARY OF THE INVENTION

An object of the present invention is to solve the above problems inherent to the prior arts by providing a mechanism by which a pair of contact points of the respective cam rollers against a disc cam are always positioned in such a manner that they confront each other in opposite areas relative to a plane including the longitudinal axes of a piston and a disc cam.

That is, the above object can be attained by an anti-rolling structure for a double headed piston of a disc cam type reciprocative compressor, which compressor comprises a cylinder block through which a plurality of pairs of front an d rear cylinder bores are provided in parallel to a drive shaft rotatably secured in the center of the cylinder block, each bore in the respective pair being disposed opposite to the other with a cam chamber intervened therebetween; a double headed piston slidably inserted in the respective pair of cylinder bores for reciprocation in the longitudinal direction of the bores; a disc cam rotatably accommodated within the cam chamber and fixedly secured to the drive shaft, which cam has a sinuous surface on front and rear sides thereof, respectively; and a pair of front and rear cam rollers, each arranged between the disc cam and the piston in a slidable manner so as to nip the disc cam with the cooperation of the other cam roller to transmit the rotation of the disc cam to the piston to cause a reciprocation of the piston in the longitudinal direction thereof, characterized in that the front and rear cam rollers are positioned so that the axes of rotation of both cam rollers are not included in the center plane defined by longitudinal axes of the piston and the disc cam but disposed, respectively, in opposite areas sectioned by the center plane with a substantially equal deviation from each other from the center plane.

According the the above structure, even when the double headed piston has reached the dead point of a stroke, the contact points of both cam rollers against the disc cam are distributed so as to nip the disc cam therebetween in opposite areas sectioned by the center plane, whereby the rolling motion of the piston can be effectively suppressed.

In an advantageous aspect of the present invention, the pair of cam rollers may be so arranged that the axes of rotation thereof are in parallel to each other and to the center plane.

In another preferably aspect, the pair of cam rollers may be so arranged that the axes of rotation thereof are at a reverse angle to each other relative to the center plane.

In further modification of the present invention, the cam roller may be formed in a hollow shape and set in place in a preliminary compressed state.

According to this modification, the weight of the cam roller can be reduced, which in turn minimizes a moment of inertia of the moving parts. Further, the cam roller can be always brought into contact with the disc cam and the piston without the generation of an excessive gap therebetween, even during a high speed operation, whereby abnormal noise and rapid wear are avoided.

BRIEF DESCRIPTION OF THE DRAWINGS

The present invention will become more apparent from the accompanying drawings illustrating the preferred embodiments, wherein:

FIGS. 1 through 5 illustrate a first embodiment of the present invention, in which;

FIG. 1 is a general side sectional view of a disc cam type compressor;

FIG. 2 is a cross-sectional view of the compressor showing an arrangement of cam rollers;

FIG. 3 is a section of a piston showing an arrangement of a pair of cam rollers relative to a disc cam when a piston has reached the dead point of a stroke;

FIG. 4 is a view similar to FIG. 3 featuring the deviation of the cam roller from the center plane; and FIG. 5 is a section taken along line B-B of FIG. 4;

FIGS. 10 through 14 illustrate the conventional arrangement of cam rollers, in which;

FIGS. 10 through 13 correspond, in order, to FIGS. 2 through 5; and FIG. 14 is a section of a piston showing an arrangement of pair of cam roller relative to a disc cam when a piston is moving from one dead point to the other dead point; and FIGS. 15 through 17 illustrate a third embodiment of the present invention, in which;

FIG. 15 is a side sectional view of a disc cam type compressor provided with cam rollers improved by the third embodiment; and FIGS. 16 and 17 are enlarged sectional views showing the action of the cam roller in the set positions.

DESCRIPTION OF THE PREFERRED EMBODIMENTS

Figure 2:
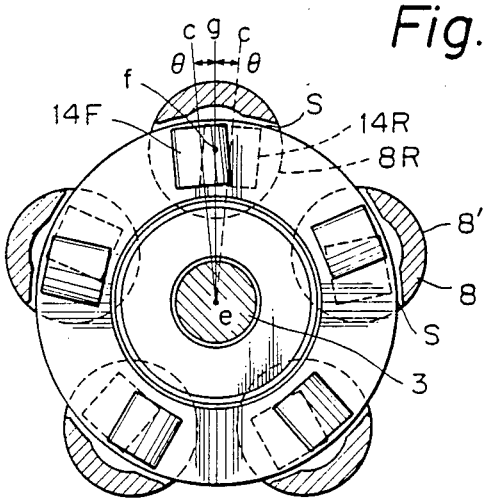
Figure 3:
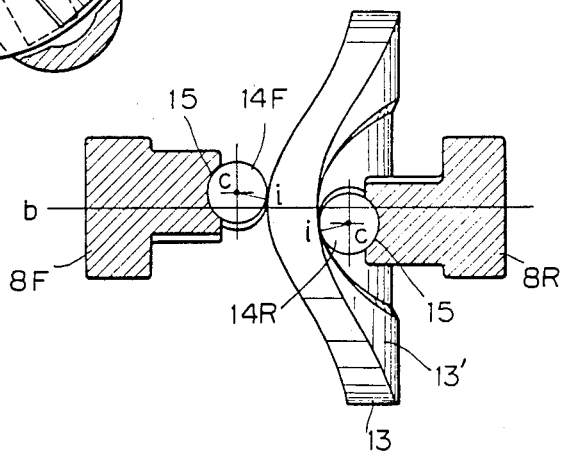
Figure 4:
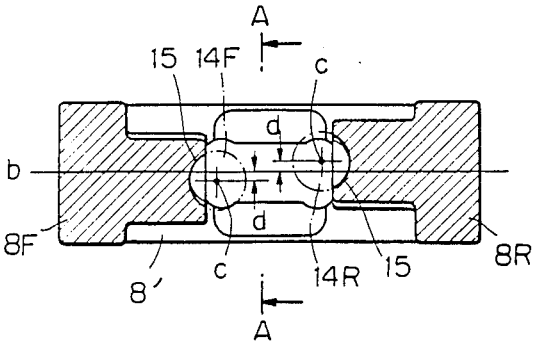
Figure 5:
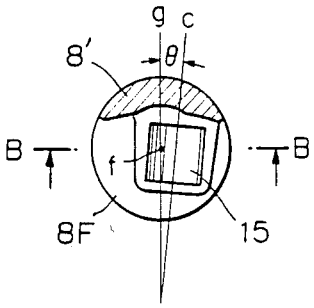
Figure 6:
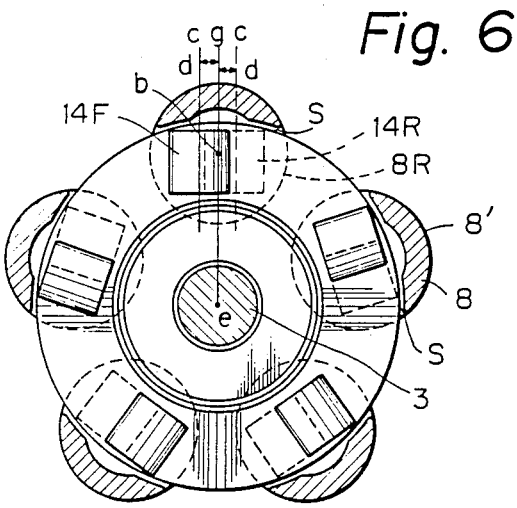
FIGS. 6 through 9 illustrate a second embodiment of the present invention, which correspond, in order, to FIGS. 2 through 5, respectively.
Figure 7:
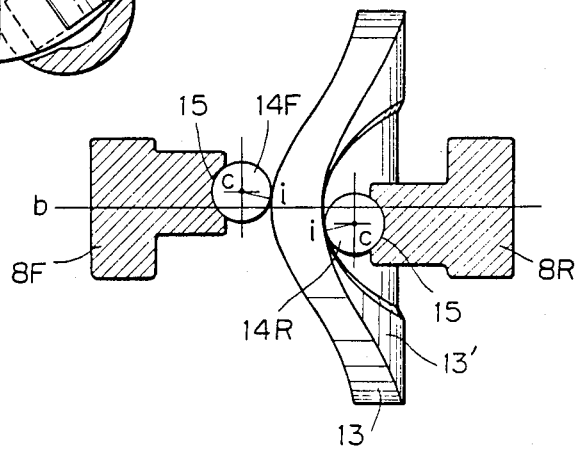
Figure 8:
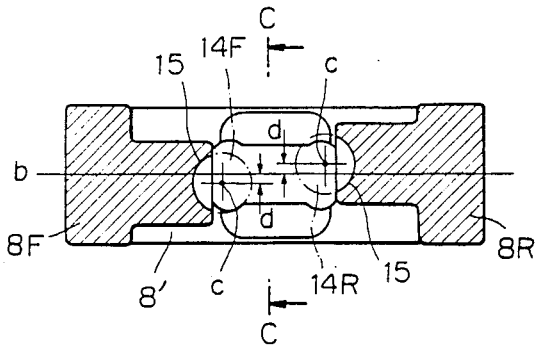
Figure 9:
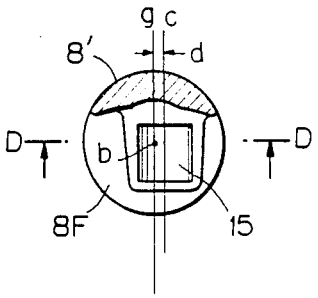
Figure 10:
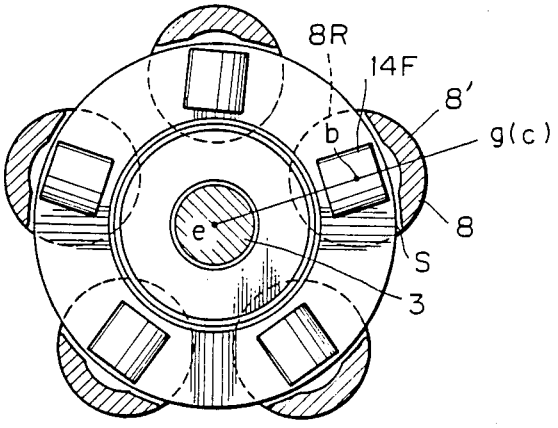
Fig. 10 PRIOR ART
Figure 11:
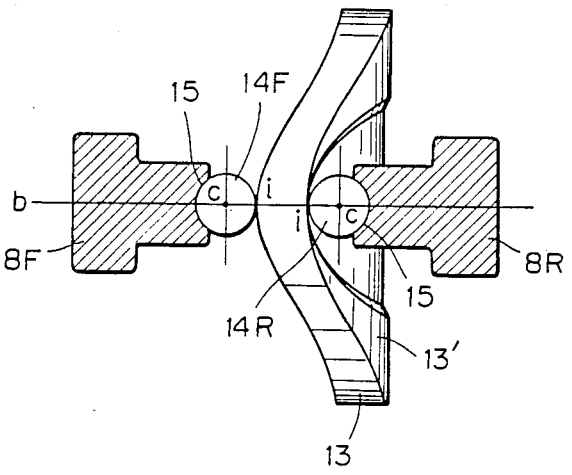
Fig. 11 PRIOR ART
Figure 12:
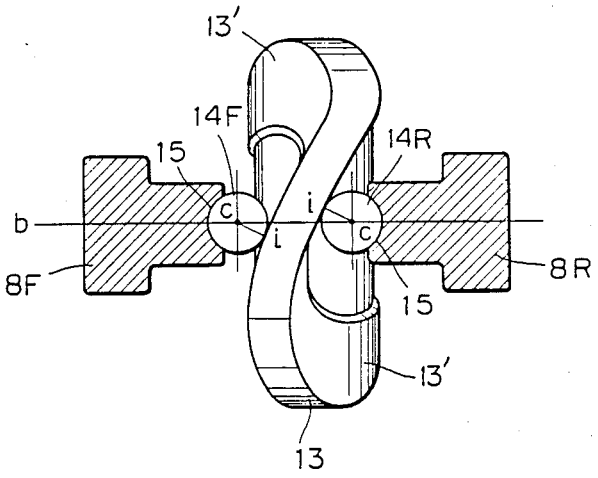
Fig. 12 PRIOR ART
Figure 13:
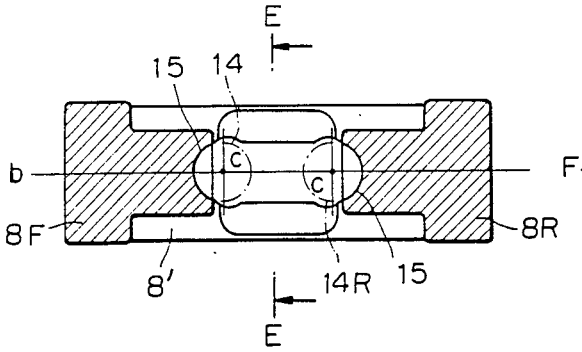
Fig. 13 PRIOR ART

A first embodiment of the present invention will be described with reference to FIGS. 1 through 5, in which a cylinder block 16 consisting of front and rear parts 16F, 16R is fixedly secured inside of a housing 1 forming an outer shell of a compressor, and a drive shaft 3 is rotatably supported by a pair of bearings 2F and 2R, each positioned in the center of the parts 16F, 16R of the cylinder block 16. The drive shaft 3 extends through a front housing 1F, described later, and is connected with an electromagnetic clutch (not shown) at one end thereof, through which clutch the drive shaft 3 can be connected to or disconnected from an engine power. The interior of both parts 16F, 16R forms a cam chamber 5, in which a disc cam 13 is rotatably accommodated while fixedly secured on the drive shaft 3. The disc cam 13 has the opposite sides thereof formed in a wavy curved shape (referred to as "sinuous surface 13'" hereinafter). A plurality of pairs of cylinder bores 4 arranged in an equi-angular manner in the cross-section of the cylinder block are formed in parallel to the drive shaft 3 through the parts 16F, 16R of the cylinder block, and the cam chamber 5 is intervened between the bores 4 formed in the front and rear parts, respectively. A double headed piston 8 is slidably inserted in the respective pair of bores so that a compression chamber 7 remains between the piston 8 and a valve plate 6F or 6R described later. The piston 8 consists of front and rear piston heads 8F, 8R and a bridge portion 8'connecting the piston heads 8F, 8R. The piston heads 8F, 8R are inserted in the pair of bores 4, respectively, and the bridge portion 8' transversely extend through the interior of the cam chamber 5. It should be noted that a clearance S is provide to avoid an undesirable contact of the bridge portion 8' of the piston 8 with the periphery of the disc cam 13, since the cylindrical cam roller used in the present invention must be engaged with both the sinuous surface 13' and the recess 15 with a predetermined clearance (shoe clearance) therebetween and an insignificant rolling motion of the piston is inevitable. Both the piston heads 8F, 8R have recesses 15, 15 arranged in a face to face manner for receiving cylindrical cam rollers 14F, 14R, respectively. The cam rollers 14F, 14R are rotatably held between the respective recess 15 and the sinuous surface 13' of the disc cam 13 so that the disc cam 13 is nipped therebetween and the rotational axes of the cam rollers extend in the radial direction of the disc cam 1, whereby the rotation of the disc cam 13 is transmitted to the piston 8 as a reciprocate linear motion. It should be noted that the pair of cam rollers 14F 14R are arranged in areas opposite each other, and these areas are separated by a center plane including the axis e of the disc cam 13 and the center axis b of the piston 8, with substantially the same small deviation relative to the former plane. More specifically, as illustrated in FIG. 4, the cam rollers 14F, 14R are positioned so that the rotational axes c thereof are arranged in areas opposite to each other and separated by the center axis b of the piston 8, with the same distance d between the respective axis c and the center axis b. This distance d is formed by arranging the recesses 15, 15 for accommodation of the cam rollers 14F, 14R while the axes c, c thereof are skewed to a line g connecting the axis b of the piston 8 and the axis e of the disc cam 13 or the shaft 3 with the same but reversed deviation angle $\ominus$, respectively, as illustrated in FIGS. 2 and 5.

Figure 1:
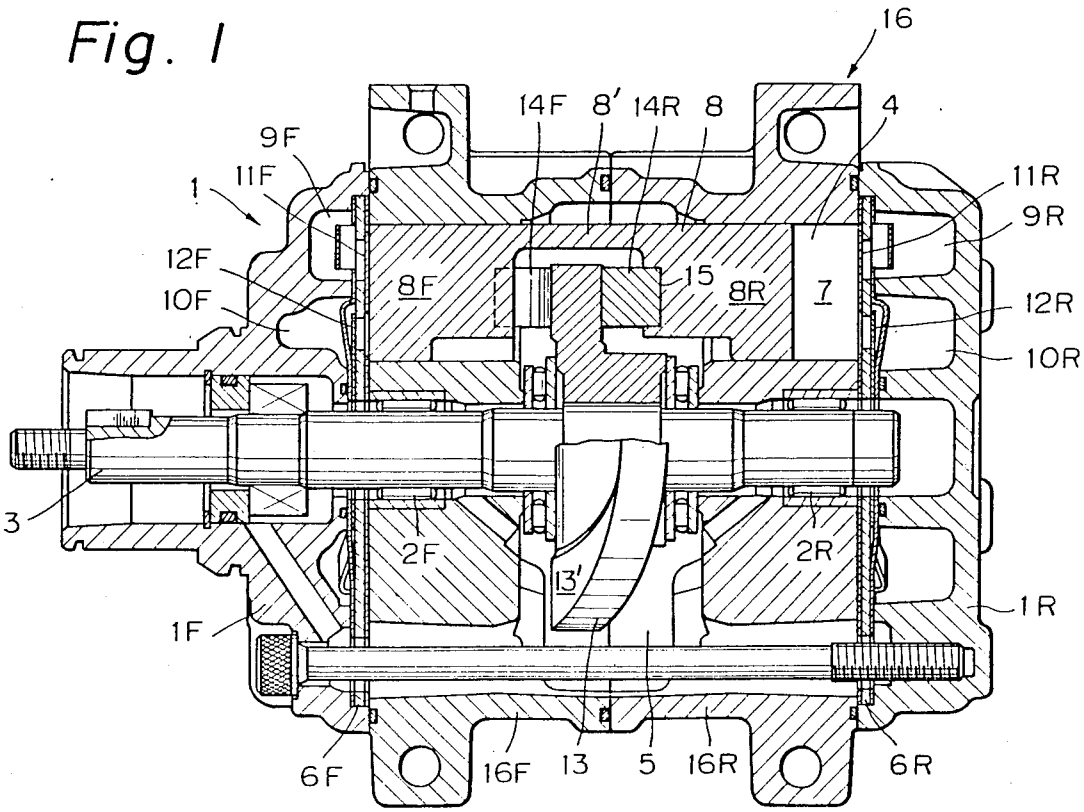

In FIG. 1, a front housing 1F is secured as a cover on the open end of the front cylinder block 16F through a front valve plate 6F. Similarly, a rear housing 1R is secured on the open end of the rear cylinder block 16R through a rear valve plate 6. Suction chambers 9F, 9R and exhaust chambers 10F, 10R are formed in both housings 1F, 1R, respectively, each of which corresponding to the respective cylinder bore 4. A suction aperture is provided on the valve plates 6F, 6R so as to correspond to the respective suction chambers 9F, 9R, respectively. Also, an exhaust aperture is provided on the valve plates 6F, 6R to correspond to the respective exhaust chambers 10F, 10R. In the suction aperture at a side confronting the compression chamber 7 are provided suction valves 11F, 11R which control the suction of air during the stroke of the piston. Also, exhaust valves 12F, 12R are provided in the exhaust aperture for controlling the compression stroke.

A second embodiment of the present invention is illustrated in FIGS. 6 through 9, in which a pair of front and rear cam rollers 14F and 14R are positioned so that the rotational axes c thereof are arranged in areas opposite to each other and separated by the center axis b of the piston 8 with the same distance d between the respective axis c and the center axis b, as in the first embodiment. However, the mechanism for realizing the deviation is different. That is, as apparent from FIG. 6 or 9, the axes c, c of the cam rollers 14F and 14R are parallel to other, not skewed to a line g connecting the axis b of the piston 8 and the axis e of the disc cam 13 or the shaft 3 with the same but reversed deviation distance d, respectively.

The operation of the disc cam type compressor according to the present invention will be described with reference to the first embodiment shown FIGS. 1 through 5. In this connection, it should be noted that the operation of the second embodiment is substantially the same as that of the first embodiment.

Figure 14:
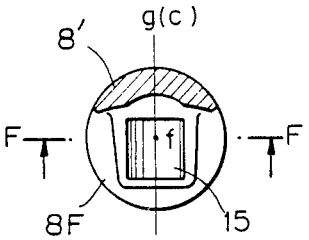
Fig. 14 PRIOR ART

The disc cam 13 is made to rotate within the cam chamber 5 by the rotation of the drive shaft 3 transmitted from an engine via a suitable means such as an electromagnetic clutch (not shown). This rotation of the shaft 3 is in turn transmitted to the piston 8, because the cam rollers 14F, 14R are disposed in the recesses 15, 15 formed in the inner walls of the piston 8 so that the cam rollers 14F, 14R are slidably and rotatably engaged with the sinuous surface 13' of the disc cam 13 and the piston 8, respectively. Accordingly, the piston 8 is reciprocated in the cylinder bore 4. During the phase of the stroke of the piston 8 in which the piston is displaced from one dead point to the other dead point, the contact points i, i of the cam rollers 14F, 14R with the respective sinuous surfaces 13' of the disc cam 13 are arranged in a favorable confronting manner relative to the center plane including the axis of the piston 8 and the disc cam 13, as shown in FIG. 14, although this relationship is established even in the conventional compressor. In accordance with the characteristic of the present invention, even in the phase when the stroke of the piston 8 has reached the dead point, the above relationship between the cam rollers and the disc cam can be maintained as shown in FIG. 3, and the rolling motion of the piston 8 toward the periphery of the disc cam 13 can be restricted. Thereby, the piston 8 can be smoothly reciprocated throughout the operation of the compressor without the bridge portion 8' thereof being brought into contact with the periphery of the disc cam 13.

Figure 15:
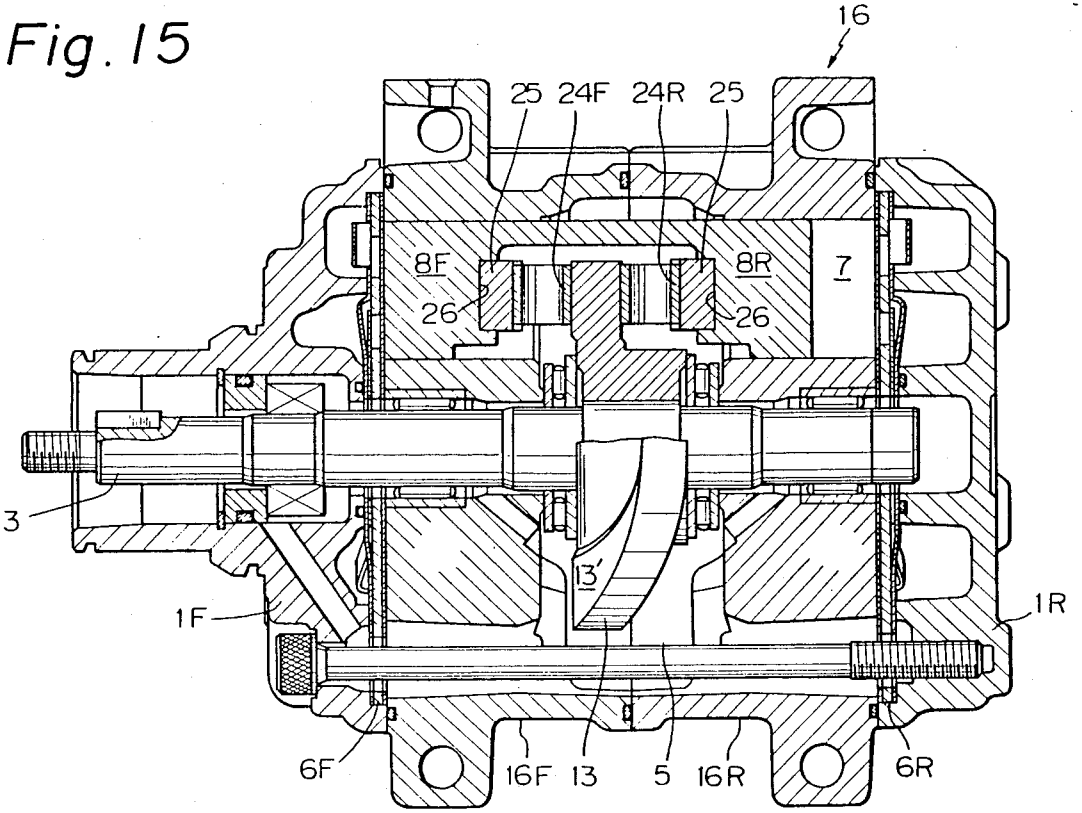
Figure 16:
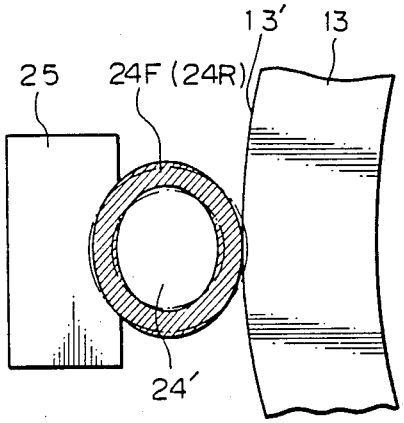
Figure 17:
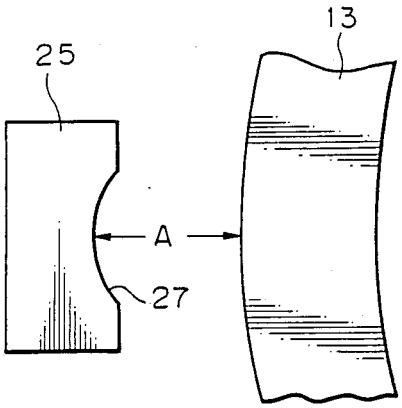

Another embodiment of the present invention is illustrated in FIGS. 15 through 17, in which a pair of cam rollers 14F, 14R of the preceding embodiments in a shape of solid cylinder are replaced by a pair of hollow cylindrical shaped cam rollers 24F, 24R combined with shoe members 25, 25, respectively. Other parts of the compressor according to this embodiment are substantially the same as those of the preceding embodiments. The shoe member 25 is fitted in a recess 26 formed in the inner wall of the piston 8 and, in turn, the hollow cam roller 24F (24R) is rotatably received in a cavity 27 formed in the inner wall of the shoe member 25 with the rotational axis thereof being directed in the direction of a radius of the disc cam 13. More specifically, the cam roller 24F (24R) is in a hollow cylindrical form having an inner space 24' and is held between the shoe member 25 and the disc cam 13 so that the opposite sides thereof ar engaged with both the sinuous surface 13' of the disc cam 13 and the inner wall of the cavity 27 of the shoe member 25. The cam roller 24 has a diameter the same as or larger than the distance between the bottom of the cavity 27 and the sinuous surface 13' when the stroke of piston 8 is at the upper dead point. The cam roller 24 is fitted therebetween in a tensed state in which the cam roller 24 has been compressed as shown in FIG. 16, whereby the shoe clearance is always self-adjustable in the most favorable state by the elastic deformation of the cam roller 24 even when the distance between the shoe 25 and the sinuous surface 13' become larger during the path from one dead point to the other dead point than in the vicinity of the dead point. Accordingly, the generation of abnormal noise during the operation and a rapid wear of the cam roller and the disc cam can be effectively avoided.

In an alternative of the above structure, the cam roller, the shoe and/or the disc cam also may be formed in a hollow shape.

We claim:

1. An anti-rolling structure for double headed piston of a disc cam type reciprocative compressor, which compressor comprises a cylinder block through which a plurality of pairs of front and rear cylinder bores are provided in parallel to a drive shaft rotatably secured in the center of the cylinder block, each bore in the respective pair being disposed opposite to the other with a cam chamber intervened therebetween; a double headed piston slidably inserted in the respective pair of the cylinder bores for reciprocation in the longitudinal direction of the bore; a disc cam rotatably accommodated within the cam chamber and fixedly secured to the drive shaft, which cam has a sinuous surface on front and rear sides thereof, respectively; and a pair of front and rear cam rollers, each arranged between the disc cam and the piston in a slidable and rotatable manner so as to nip the disc cam in cooperation with the other cam roller to transmit the rotation of the disc cam to the piston as a reciprocation in the longitudinal direction thereof, characterized in that the front and rear cam rollers are positioned so that the axes of rotation of both cam rollers are not included in the center plane defined by longitudinal axes of the piston and the disc cam but disposed, respectively, in opposite areas sectioned by the center plane with a substantially equal deviation from each other from the center plane.

2. An anti-rolling structure for double headed piston of a disc cam type reciprocative compressor defined by claim 1, characterized in that the axes of rotation of the cam rollers are in parallel to each other and to the center plane.

3. An anti-rolling structure for double headed piston of a disc cam type reciprocative compressor defined by claim 1, characterized in that the axes of rotation of the cam rollers are at a reversed angle to each other relative to the center plane.

4. An anti-rolling structure for double headed piston of a disc cam type reciprocative compressor defined by claim 1, characterized in that the cam roller is formed in a hollow shape and fitted in place in a preliminary compressed state in the radial direction.

* * * * *